US007850039B1

(12) United States Patent
Tsengas

(10) Patent No.: US 7,850,039 B1
(45) Date of Patent: Dec. 14, 2010

(54) WASTE BAG HOLDER FOR REFILL ROLL

(75) Inventor: Steven Tsengas, Fairport Harbor, OH (US)

(73) Assignee: OurPet's Company, Fairport Harbor, OH (US)

( * ) Notice: Subject to any disclaimer, the term of this patent is extended or adjusted under 35 U.S.C. 154(b) by 236 days.

(21) Appl. No.: 12/170,671

(22) Filed: Jul. 10, 2008

Related U.S. Application Data

(60) Provisional application No. 60/965,038, filed on Aug. 17, 2007.

(51) Int. Cl.
*B65H 1/00* (2006.01)

(52) U.S. Cl. ..... 221/45; 221/70; 206/409; 206/494

(58) Field of Classification Search ..... 119/796; 221/45, 70; 206/409, 205, 494; 242/595
See application file for complete search history.

(56) References Cited

U.S. PATENT DOCUMENTS 4,718,707 A 1/1988 Greenhut
5,176,272 A * 1/1993 Ryan ..... 220/4.23
5,642,810 A * 7/1997 Warner et al. ..... 206/389
5,950,959 A * 9/1999 Milliorn ..... 242/588.3
6,003,669 A * 12/1999 Baricevic ..... 206/408
6,223,695 B1 * 5/2001 Edwards et al. ..... 119/796
6,446,808 B1 * 9/2002 Paul et al. ..... 206/494
D464,179 S * 10/2002 Petersen et al. ..... D30/162

OTHER PUBLICATIONS http://www.petco.com, Jul. 3, 2008, PETCO Doggy Scoop Bags at PETCO, p. 1 of 4.
http://www.biobagusa.com/biobag_dog.htm, Jul. 3, 2008, Certified 100% biodegradable Dog was bags and cat pan liners, p. 1 of 3.
http://www.bagsonboard.com/Bags_On_Board.html, Jul. 3, 2008, Bags on Board, p. 1 of 2.

* cited by examiner

*Primary Examiner*—Gene Crawford
*Assistant Examiner*—Timothy R Waggoner
(74) *Attorney, Agent, or Firm*—John D. Gugliotta, Esq.

(57) ABSTRACT

The present invention relates generally to dog waste bag holder and, more specifically, to a travel waste bag holder capable of accepting roll refills. The instant abstract is neither intended to define the invention disclosed in this specification nor intended to limit the scope of the invention in any way.

13 Claims, 2 Drawing Sheets

WASTE BAG HOLDER FOR REFILL ROLL

RELATED APPLICATIONS

The present invention is a continuation of U.S. Ser. No. 60/965,038 and it claims priority to that provisional's Aug. 17, 2007 filing date. The present invention incorporates subject matter of the '038 application as if it is entirely rewritten herein.

BACKGROUND OF THE INVENTION

1. Field of the Invention

The present invention relates generally to a dog waste bag holder and, more specifically, to a travel waste bag holder capable of accepting roll refills.

2. Description of the Related Art

Many dog owners take their dogs for daily walks, but these owners cannot always anticipate when their adored pets will utilize a neighbor's yard for restroom purposes. In the past, a considerate neighbor picked up a pet's waste if it fell on another's property. Most often, this person carried a plastic grocery bag, used it to pick the waste up, tied it and carried it home to toss it in the garbage. Presently, most housing associations require all owner's pick up pet waste so that landscapers don't have to comb the yards for it before cutting grasses and so that those neighbors without pets don't become disgruntled.

Many cities' ordinances also require that pet waste be picked up on city properties. A number of pet friendly parks similarly require waste to be picked up for a pet privilege to remain. To further encourage this gesture, a stand may be mounted to dispense plastic bags. The stand is located adjacent to garbage pails so that no inconvenience is placed upon pet owners; however, these stands are not yet universally adopted because they are only recently gaining popularity.

Plastic grocery bags are not the most attractive means to pick up waste for the many environmentally conscious pet owners. Finer foods grocers pack in papers or in cloths that shoppers carry, so their shoppers don't even have plastic bags to utilize. Another problem encountered by less environmentally concerned pet owners is that they typically have to pick up waste at least two times a day, the number of weekly bags of which are required for a dog outnumber the number of bags taken from the grocery. Therefore, the both are sometimes left with no means to pick up waste.

The present invention teaches a disposable waste bag holder that contains a roll of biodegradable bags. A dog walker can carry the present invention or it can be conveniently secured to a garage or a utility space. A search of the prior art reveals no patents that are related to the present teachings; however, the following references are considered pertinent art:

U.S. Pat. No. 4,718,707 teaches a disposable waste scooper that comprises an economically disposable container having a wire frame that holds a flexible bag. After the frame is dragged across a ground to scoop the waste, the cardboard device is pushed against a cover to close the 99% biodegradable bag.

PetGold™ Doggy Scoopbags are marketed as fresh scented, opaque colored, recycled plastic bags packed in a box. DoggieWalk Bass Co., BioBag® Dog, by BIOgroupUSA, Inc. and Bags on Board® by The Brampton Company all market similar-type bags in boxes, wherein a pet owner pulls one waste bag from the box before walking a dog.

There is a long felt need for a novel and an improved means to contain waste bags and to clean up dog waste. The present waste bag holder is capable of being refilled with corresponding rolls of biodegradable bags.

SUMMARY OF THE INVENTION

It is an object of the present invention to provide an improved means to pick up the waste left by dogs on others' properties. It is an object that the present invention provides such a means in the form of a novel waste bag holder adapted to contain a corresponding roll of bags.

It is an object that the waste bag holder is not a consumable product, but it is rather a refillable one so that it can be continuously used for a plurality of rolls. It is an object that because the waste bag rolls are consumable, they are therefore environmentally friendly. It is a preferred object that the holder and the roll are both environmentally friendly products.

It is anticipated that the foregoing object is accomplished by means of a holder preferably manufactured from a compressed, recycled cardboard. It is a further object that a means is provided to waterproof the cardboard so that it is not affected by wet weather conditions. It is envisioned that an inexpensive, disposable clear vacuum sealing or a plastic is injection molded to form over the cardboard.

It is an object that the present invention is light and conveniently sized so that it can be carried on a pet owner while he or she is walking a pet. It is an object that a means is provided to removeably secure the waste bag holder to a person. It is an object that such a means is an aperture comprised at a very distal end to accept a chain, a clip or another similar means.

Briefly described according to a preferred embodiment of the present invention, a waste bag holder comprises two mirrored portions that mate to form a compartment therebetween. The mirrored portions mate to essentially comprise a cylindrical shaped compartment having closed ends. A planar extension extends outwards along a length of each of the portions. A corresponding means to lockingly secure the two portions are comprised on each of their respective mating surfaces. In a closed position, a single extension forms outwards from the cylindrical shaped portion of the holder. The opposite length of the holder comprises a slot for a dispensing of disposable bags. A window is formed along and across an, entire portion of the cylindrical shaped holder section. When the window shows that the waste bag roll is near empty, the mirrored portions open to accept a biodegradable waste bag roll refill.

In an alternative embodiment to the present invention, a waste bag holder is similar in shape to the previously described one, except that an almost flat, dispenser section extends from the opposite length of the roll. The dispenser section extends from the holder to guide a travel of the perforated waste bags when the invention is utilized.

It is envisioned that the present invention will provide all of the advantages that the foregoing objects and description entail, the advantages of which are better understood with reference to the more detailed sections.

BRIEF DESCRIPTION OF THE DRAWINGS

The advantages and the features of the present invention are better understood with reference to the following and mare detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
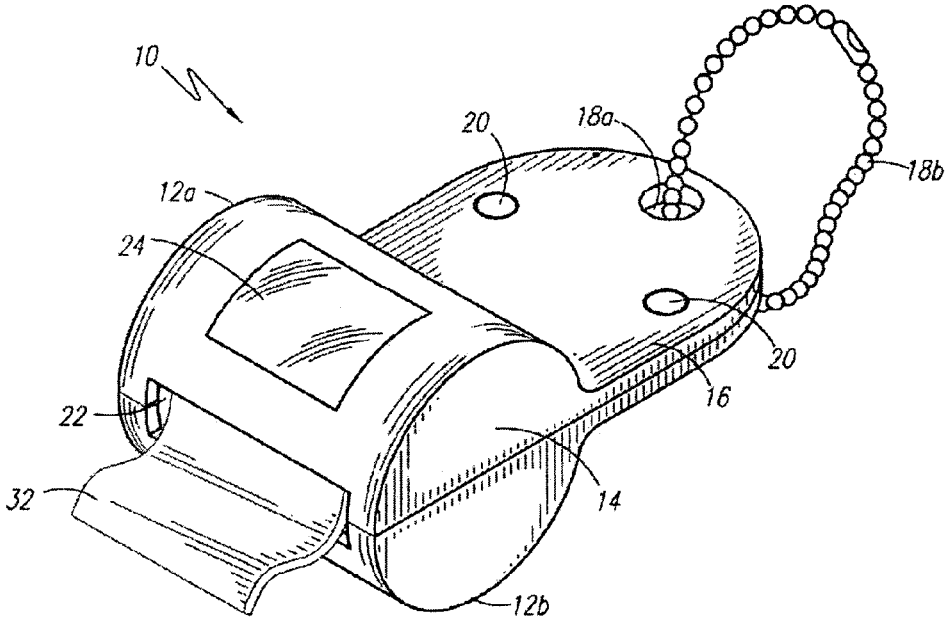
FIG. 1 is an elevational view of the waste bag holder according to a preferred embodiment of the present invention, wherein the waste bag holder is in a closed position.
Figure 2:
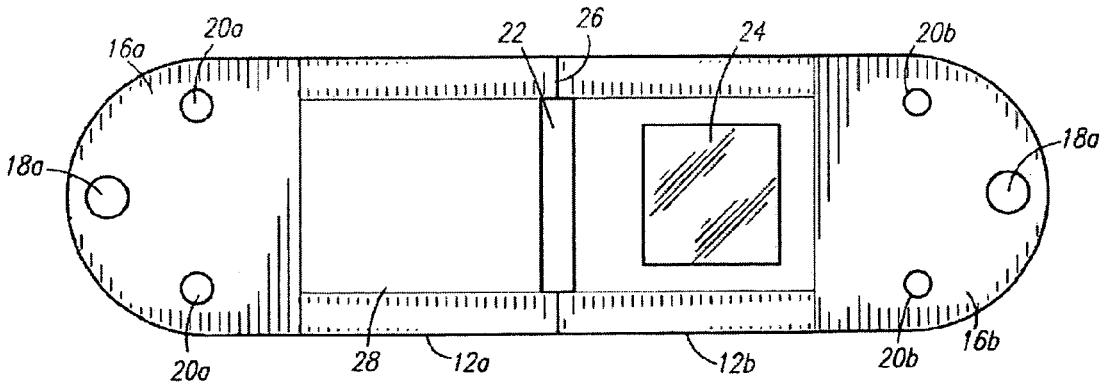
FIG. 2 is a top view of the waste bag holder of FIG. 1, wherein the waste bag holder is in a fully opened position.

A preferred embodiment of the present dog waste bag holder ("bag holder") 10 is shown in both FIGS. 1 and 2. An elevational view of the bag holder is shown in FIG. 1 in a fully closed position. The bag holder 10 essentially comprises two mirrored portions 12*a*, 12*b* that mate to form a closed cylindrical portion 14. The cylindrical portion 14 comprises a diameter that approximates 4.5 to 5.0 centimeters; it measures a length that approximates 6.5-7.0 cm across. A planar extension 16 extends outwards along a length of the cylindrical portion 14. The planar extension 16 is not limited to a shape having a rounded distal end, as shown in FIG. 1, but it may rather comprise any shape or form. The planar extension 16 comprises an aperture 18*a* at its very distal end. It is preferred that the present bag holder 10 can be removeably wrapped around the wrist of a walking person, clipped onto a belt of that person, or hung on a clothes hook in a utility, etc. The aperture 18*a* is provided as a means to secure a chain 18*b*, a rope, a clip or any other similar functioning device to the bag holder 10.

A corresponding means to lockingly secure 20 the two portions 12*a*, 12*b* are comprised on each of their respective extensions. It is envisioned that the locking means 20 comprise a snap-and-lock engagement, wherein a simple tug of the' portions 12*a*, 12*b* opens the bag holder 10 for access to its interior. Any other similar locking means 20 may be comprised as an alternative to the snap-and-lock engagement, such as, for example, a peripheral ridge that mates with a corresponding channel, etc.

The opposite length of the bag holder 10 comprises a slot 22 for a dispensing of disposable bags. It is envisioned that a bottom length of the slot 22 may comprise rigid teeth to assist in a tear of bags if a roll comprises perforated bags.

At least one window 24 is formed along and across an entire top and/or bottom portion of the cylindrical shaped holder section 12. The window 24 provides a person with a means to monitor the number of remaining bags available on a roll refill. When the roll empties, a refill can be placed in the cylindrical portion 12 by means of an opening of the two portions 12*a*, 12*b*, as shown in FIG. 2.

The two mirrored portions 12*a*, 12*b* are hingedly attached at the distal end of the bag roller 10 at the slot 22. A bag holder 10 is shown in FIG. 2 in a fully opened position. As can be seen in FIG. 2, a living hinge 26 is formed at the slot such that the mating portions are positioned at opposing ends. As can be seen on the corresponding mating surfaces 16*a*, 16*b* (that combine to form the extension 16 shown in FIG. 1), a snap 20*a* is formed on the first portion 12*a* to mate with a lock engagement 20*b* on the second portion 12*b*. It is envisioned that the snap locks 20*a*, 20*b* are glued onto their respective mating surfaces 16*a*, 16*b*, but they may be permanently secured to the surfaces by any means well known in the art to accomplish such a purpose.

A refillable roll (not shown) of biodegradable bags is placed within a compartment 28. It is anticipated that a roll approximate a 3.6 cm diameter, such that it can snuggly fit in the compartment 28. The first bag on a roll is placed facing the slot 22. It is anticipated that the first bag can be slightly pulled through the slot 22 and then the mating surfaces 16*a*, 16*b* are closed along the living hinge 26.

Figure 3:
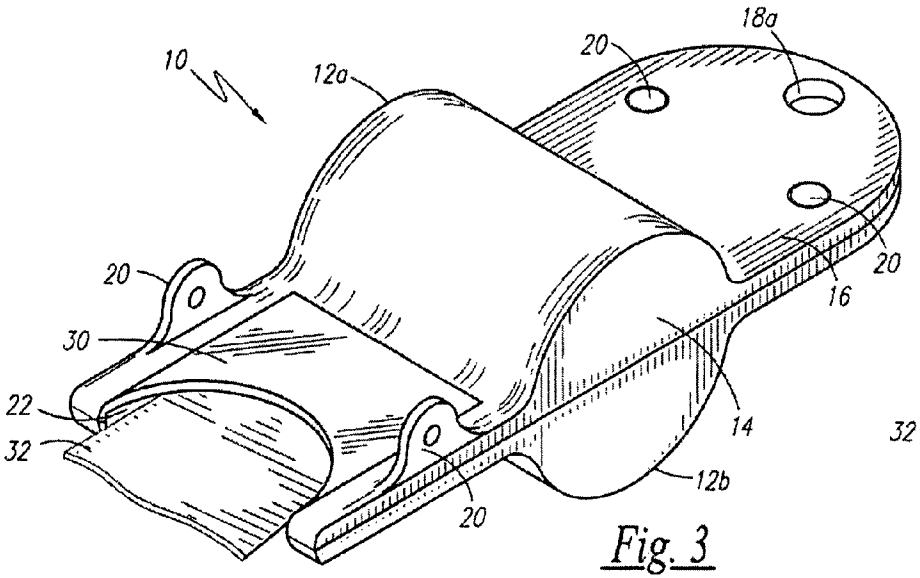
FIG. 3 is an elevational view of an alternative embodiment to the present invention.
Figure 4:
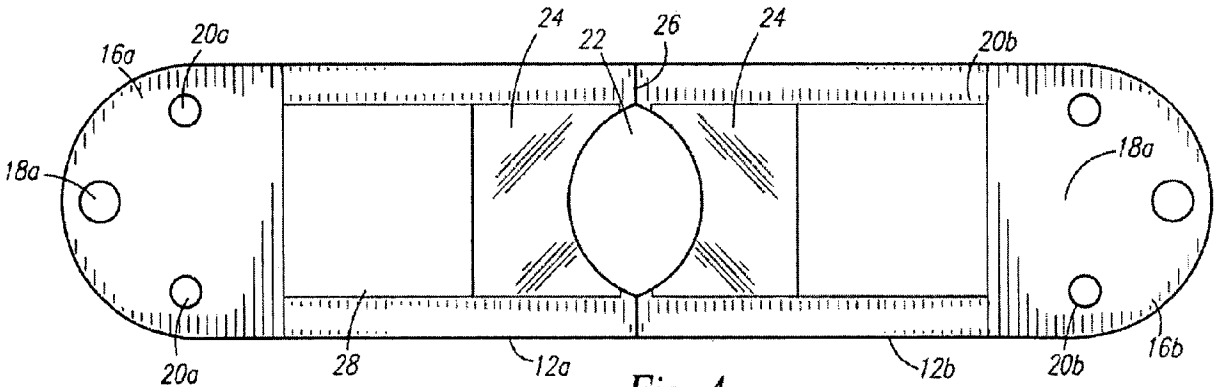
FIG. 4 is a top view of the waste bag holder of FIG. 3, wherein the waste bag holder is in a fully open position; and, FIG. 5 is a waste bag roll that is inserted into either waste bag holder of FIGS. 1-4.

An alternative embodiment of the present invention is shown in FIGS. 3 and 4. A bag holder alternatively comprises two portions 12*a*, 12*b* not connected at a living hinge, but rather two portions that are secured by a plurality of snap-and-lock engagements. In this embodiment, a planar dispenser portion 30 extends from a length of the cylindrical portion 12 opposite the extension 16. A second means to lockingly engage 32 the two portions 12*a*, 12*b* is comprised on the dispenser portion 30. A concave-shaped distal end 32 provides a slot 22 for the disposable bags to be dispensed from.

FIG. 4 shows a first 12*b* of the two portions that mate to close a bag holder 10. A top view of the first portion 12*b* is shown, wherein a compartment 28 is formed like that of the preferred embodiment. A roll refill is placed in the compartment 28, and the first bag is pulled along a mating surface that forms the dispenser extension portion 30. The second portion 12*a* is then placed over the roll, and the snaps are pressed to engage the corresponding locks to contain the roll therein.

Figure 5:
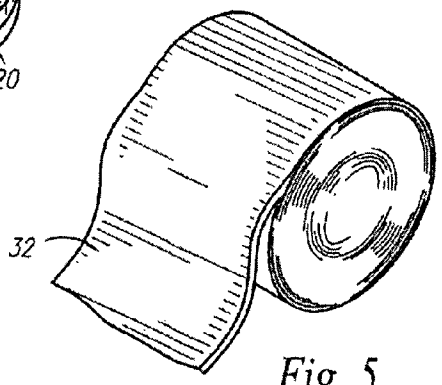

FIG. 5 shows a refill roll 32 that is placed in the compartments of the bag holders 10. It is anticipated that the bags that comprise the rolls are biodegradable. It is further anticipated that the present invention is similarly environmentally friendly, wherein the bag holder 10 is preferably manufactured from a compressed, recycled cardboard. It is further envisioned that a means is provided to waterproof the cardboard so that dog walks in wet weather conditions do not affect it. An inexpensive, disposable clear vacuum sealing is either vacuum formed or injection molded over the cardboard. Therefore, a discarding of the present bag holder 10 with an empty roll 32 will not greatly affect the environment.

2. Operation of the Preferred Embodiment

To operate a preferred embodiment of the present invention, a tug of the mirrored portions at the extension unlocks the snap engagements such that the dog waste bag holder can be opened. A biodegradable plastic waste bag refill roll is placed within the cylindrical shaped compartment with a first bag facing a slot formed at the living hinge in a center. The first perforated bag is slightly pulled through the slot and the two portions are closed upon one another and snap locked into place. To use the bags, a slight tug of a first bag will dispense one bag at a time. A window formed on the cylindrical portion, i.e., the bag roll compartment, provides a means for persons to view the number of bags remaining on the roll.

The foregoing descriptions of the specific embodiments of the present invention are presented for the purposes of illustration and description. They are neither intended to be exhaustive nor to limit the invention to the precise forms disclosed and, obviously, many modifications and variations are possible in light of the above teaching. The embodiments were chosen and described in order to best explain the principles of the invention and its practical application, to thereby enable others skilled in the art to best utilize the invention and its various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A dog waste bag holder comprises two mirrored portions that mate to form a closed cylindrical portion, each of said portions comprises at least one pair of mating surfaces that combine to form at least one planar extension to extend outwards along a length of said cylindrical portion, wherein said bag holder comprises a slot at a distal end of the bag holder for dispensing of disposable bags and wherein said two portions are hingedly attached at said distal end of the bag holder at said slot.

2. The bag holder of claim 1, wherein said planar extension comprises an aperture at its very distal end.

3. The hag holder of claim 1, wherein said cylindrical portion comprises a diameter that approximates 4.5 to 5.0 centimeters.

4. The bag holder of claim 3, wherein said cylindrical portion measures a length that approximates 6.5-7.0 cm across.

5. The bag holder of claim 2, wherein said aperture is provided as a means to secure a chain, a rope, a clip or any other similar functioning device to said bag holder, said bag holder can be removeably wrapped around a wrist of a walking person, clipped onto a belt of said person or hung on a clothes hook in a utility.

6. The bag holder of claim 1 further comprises a corresponding means to lockingly secure said two portions at each of their respective extensions.

7. The bag holder of claim 6, wherein said locking means comprises:

at least one snap that mates with at a corresponding lock engagement; and, a peripheral ridge that mates with a corresponding channel.

8. The bag holder of claim 1, wherein at least one window is formed along and across an entire portion of said cylindrical shaped holder section.

9. The bag holder of claim 1, wherein a refillable roll of biodegradable bags is placed within a cylindrical shaped compartment formed by said two portions.

10. The bag holder of claim 1, wherein said slot is comprised on a length of said bag holder opposite a first of said at least one extension.

11. The bag holder of claim 1, wherein said slot is comprised on a second extension opposite a first of said at least one extension.

12. The bag holder of claim 1, wherein said bag holder is manufactured from a compressed, recycled cardboard.

13. The bag holder of claim 12, wherein an inexpensive, disposable clear plastic sealing is either vacuum formed or injection molded over said cardboard, said plastic sealing is provided as a means to waterproof said cardboard so that dog walks in wet weather conditions do not affect it.

* * * * *